US007681537B2

(12) United States Patent
Savage et al.

(10) Patent No.: US 7,681,537 B2
(45) Date of Patent: Mar. 23, 2010

(54) GAS EXTRACTOR FOR AN ENGINE COOLANT SYSTEM

(75) Inventors: Howard S. Savage, Columbus, IN (US); Kerk B. McKeon, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 0 days.

(21) Appl. No.: 12/193,019

(22) Filed: Aug. 17, 2008

(65) Prior Publication Data

US 2010/0037836 A1 Feb. 18, 2010

(51) Int. Cl.
*F01P 3/22* (2006.01)

(52) U.S. Cl. ..... 123/41.54; 123/41.01

(58) Field of Classification Search ..... 123/41.01, 123/41.3, 41.44, 41.45, 41.54, 41.15
See application file for complete search history.

(56) References Cited

U.S. PATENT DOCUMENTS 1,658,934 A * 2/1928 Muir ..... 123/41.54
3,623,462 A 11/1971 Anders et al.
3,989,103 A 11/1976 Cieszko et al.
4,006,775 A 2/1977 Avrea
4,098,328 A 7/1978 Cheong
4,366,858 A 1/1983 Moranne
5,306,430 A * 4/1994 Dixon et al. ..... 123/41.14
6,135,067 A * 10/2000 Klamm et al. ..... 123/41.54
6,962,656 B2 11/2005 Davidian et al.

* cited by examiner

*Primary Examiner*—Noah Kamen
(74) *Attorney, Agent, or Firm*—Studebaker & Brackett PC; Tim L. Brackett, Jr.; J. Bruce Schelkopf

(57) ABSTRACT

A system and method for removing gases from an engine coolant system. In one embodiment, the system includes a fluid system that is operable to collects gas, and a gas collection system coupled to the fluid system. The system also includes a venturi pump system coupled to the fluid system and to the collection system, where the venturi pump system is operable to extract the gas from the fluid system via the collection system.

20 Claims, 4 Drawing Sheets

300

300

GAS EXTRACTOR FOR AN ENGINE COOLANT SYSTEM

FIELD OF THE INVENTION

The present invention relates to engine systems, and more particularly to a system and method for removing gas from an engine coolant system.

BACKGROUND OF THE INVENTION

Engine coolant systems are well known. Engine coolant systems typically include a radiator that cools and circulates coolant fluid through an engine in order to cool the temperature of the engine. One problem with engine coolant systems is that air can become trapped in the engine coolant system. A problem with entrained air in the engine coolant system is that the entrained air reduces heat transfer. In addition, the air can cause thermal shock failure. For example, if there is a substantial amount of air with a few droplets, the surfaces of the coolant system can get quite hot. When a drop hits a surface of the coolant system, the temperature in a very small region (e.g., at the contact point) drops quickly. This may cause cracks in the engine coolant system. Also, the propagation of the thermal stress is rapid, because the cycle rate can be very high.

Accordingly, what is needed is an improved system and method for handling air in a coolant system. The present invention addresses such a need.

SUMMARY OF THE INVENTION

A system and method for removing gases from an engine coolant system are disclosed. In one embodiment, the system includes a fluid system (e.g., heat exchanger) that is operable to collects gas, and a gas collection system coupled to the fluid system. The system also includes a venturi pump system coupled to the fluid system and to the collection system, where the venturi pump system is operable to extract the gas from the fluid system via the collection system. According to the method disclosed herein, gas is extracted from the engine coolant system in a simple and efficient manner.

DETAILED DESCRIPTION OF THE INVENTION

The present invention relates to engine systems, and more particularly to a system and method for removing gas from an engine coolant system. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

A system and method in accordance with the present invention for removing gas from an engine coolant system are disclosed. The method includes collecting gas in a fluid system. The fluid system also collects coolant fluid for cooling an engine. A pump system that includes a venturi pump that uses the coolant flow to extract the gas from the fluid system. The venturi pump uses the coolant flow from the fluid system via a fluid system outlet and extracts the gas from the fluid system via a gas collection system. As a result, gas is extracted from the engine coolant system in a simple and efficient manner. To more particularly describe the features of the present invention, refer now to the following description in conjunction with the accompanying figures.

Figure 1:
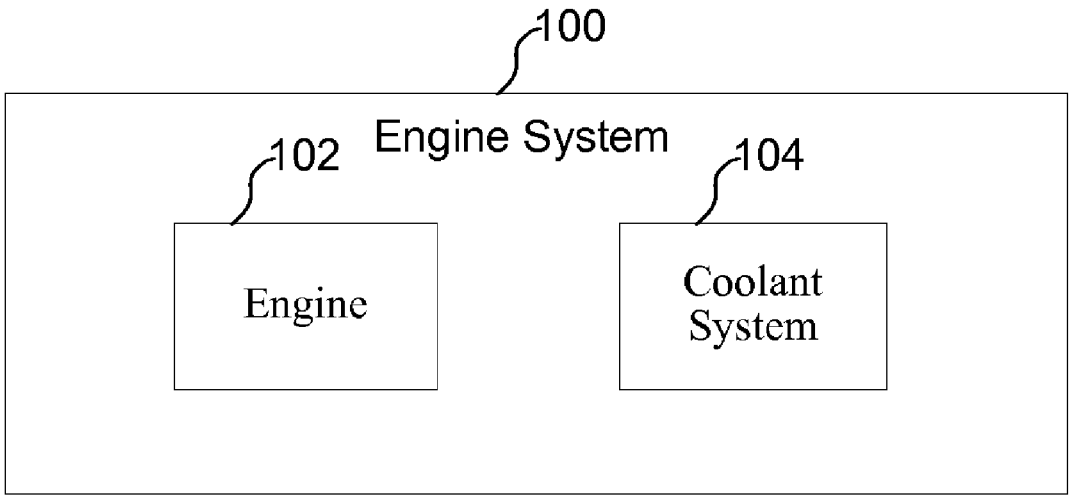
FIG. 1 is a block diagram of an engine system in accordance with one embodiment.
Figure 2:
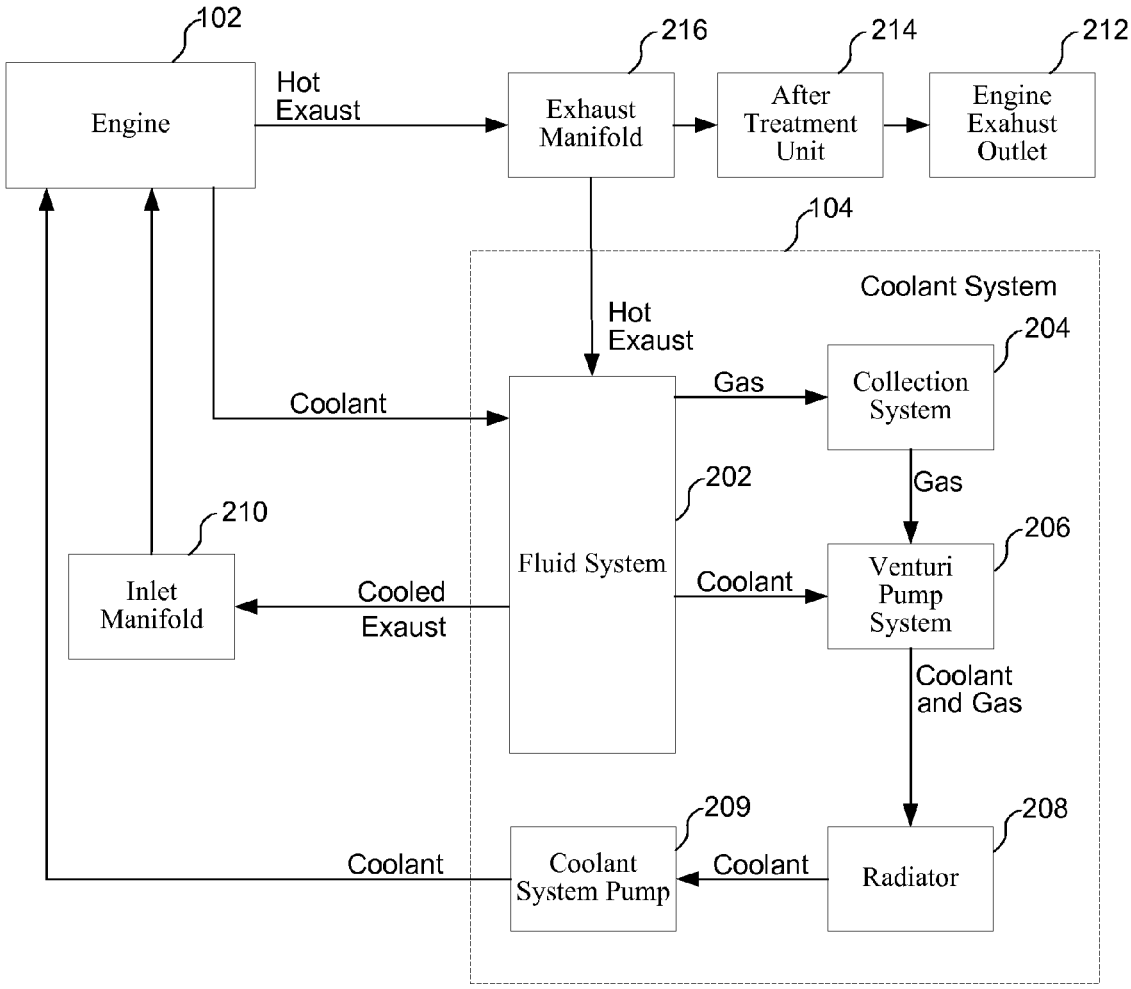
FIG. 2 is a block diagram of an engine coolant system in accordance with one embodiment.

FIG. 1 is a block diagram of an engine system 100 in accordance with one embodiment. As FIG. 1 shows, the engine system 100 includes an engine 102 and a coolant system 104. Although embodiments of the present invention disclosed herein may be applied in the context of vehicles, embodiments of the present invention may also have non-vehicle applications, and still remain within the spirit and scope of the present invention. For example, the engine system 100 may be part of a vehicle, a generator set or other engine applications, etc. FIG. 2 is a block diagram of an engine coolant system 104 in accordance with one embodiment. As FIG. 2 shows, the coolant system 104 includes a fluid system 202, a gas collection system 204, a venturi pump system 206, a radiator 208, and a coolant system pump 209. In one embodiment, the fluid system 202 is an exhaust gas recirculation (EGR) cooler. As described in more detail below, the fluid system 202 contains a coolant fluid that circulates through the venturi pump system 206, the radiator 208, the coolant system pump 209, and the engine 102. Coolant fluid passes through the fluid system 202 before the venturi pump system 206 on the way to the radiator 208. The radiator 208 cools the coolant fluid before the coolant fluid enters the engine 102 to cool the engine 102 and the fluid system.

As described in more detail below, in one embodiment, gas forms in the fluid system 202. The venturi pump system 206 extracts the gas from the fluid system 202 via the gas collection system 204 and sends the gas along with the coolant fluid to the radiator 208 and the coolant system pump 209. The radiator 208 may then expel the gas in any suitable manner.

In one embodiment, an inlet manifold 210 receives cooled exhaust from the engine 102 by way of the fluid system (e.g., EGR cooler) 202 and air from an air inlet. Exhaust passes to the engine exhaust outlet 212 through the exhaust manifold 216 the after-treatment unit 214. Alternatively, in one embodiment, exhaust from the exhaust manifold 216 can pass through the fluid system 202 (e.g., EGR cooler) and be returned to the engine 102 through the inlet manifold 210. The fluid system 202 in this case would function as a heat exchanger that uses the engine coolant to cool the exhaust stream as part of an EGR circuit.

Figure 3:
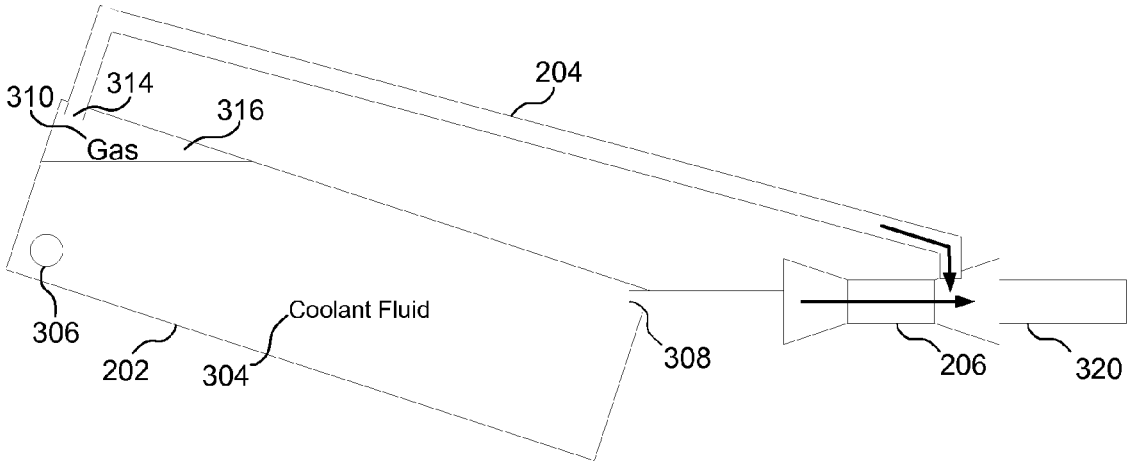
FIG. 3 is a block diagram of a gas extraction system in accordance with one embodiment.

FIG. 3 is a block diagram of a gas extraction system 300 in accordance with one embodiment. As FIG. 3 shows, the gas extraction system 300 includes the fluid system 202, the gas collection system 204, and the venturi pump system 206. The fluid system 202 contains coolant fluid 304, and the coolant fluid 304 enters the fluid system 202 through a fluid system inlet 306 and exits the fluid system 202 through a fluid system outlet 308. As the coolant fluid 304 enters the fluid system 202, gas 310 entrained in the coolant fluid 304 may form bubbles that may be trapped within the fluid system 202. In one embodiment, the gas collection system 204 is a connecting tube having one end 314 that extends into a gas collection area 316 within the fluid system 202. As FIG. 3 shows, the fluid system outlet 308 is separate from the gas collection system 204. The gas collection system 204 is connected between the fluid system 202 and the pump system 206. In one embodiment, the pump system 206 is a venturi pump. The pump system 206 includes a pump outlet 320. As FIG. 3 shows, in one embodiment, the gas collection system 204 and the pump system 206 are external to the fluid system 202. Alternatively, in another embodiment, the gas collection system 204 and the venturi pump system 206 are internal to the fluid system 202.

Figure 4:
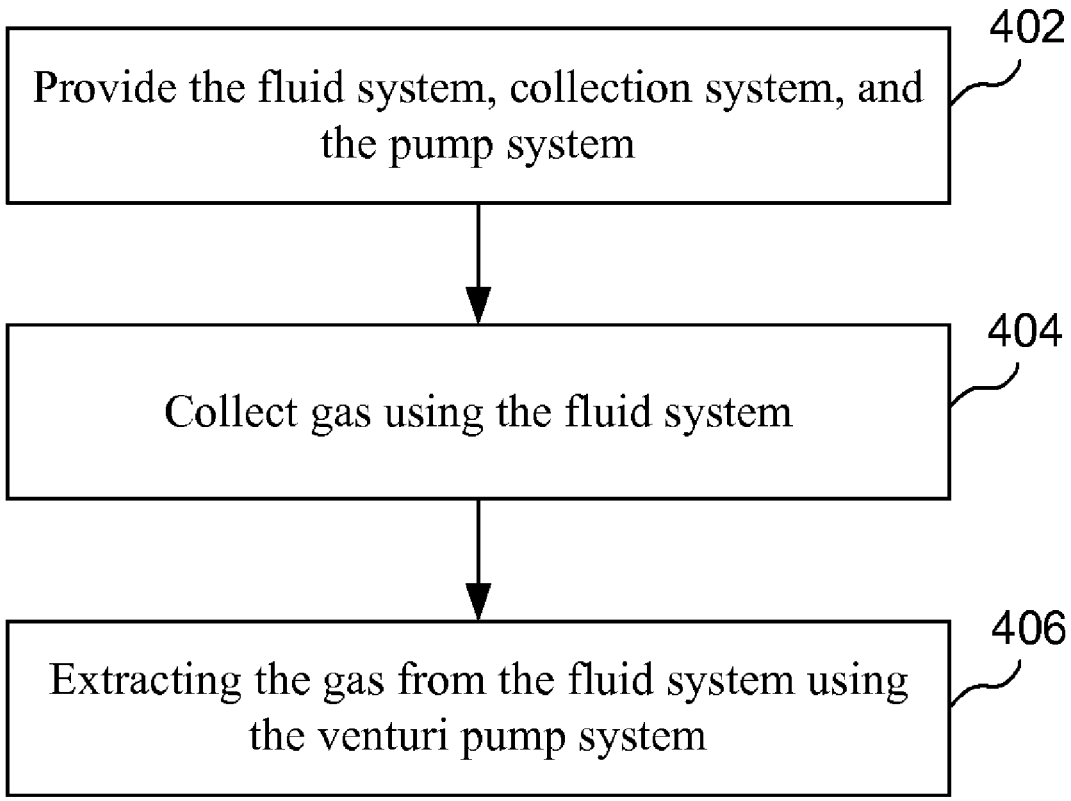
FIG. 4 is a flow chart showing a method for extracting trapped gas from an engine coolant system in accordance with one embodiment.

FIG. 4 is a flow chart showing a method for extracting trapped gas from an engine coolant system in accordance with one embodiment. Referring to both FIGS. 3 and 4 together, the process begins in step 402 where the fluid system 202, gas collection system 204, and the pump system 206 are provided. Next, in step 404, the fluid system 202 collects gas along with coolant fluid. In one embodiment, the fluid system 202 is oriented in a manner to consolidate the gas 310 at the gas collection area 316. In one embodiment, the fluid system 202 includes a container that is tilted such that the gas accumulates at a high point and in the uppermost corner or gas collection area 316 of the fluid system 202. In one embodiment, the fluid system 202 has a geometrical shape that facilitates the trapped gas 310 to consolidate at the gas collection area 316. In one embodiment, the gas collection area 316 is next to the fluid system inlet 306 (e.g., on the same end of the fluid system 202). Next, in step 406, the pump system 206 extracts the gas from the fluid system 202 via the gas collection system 204. In one embodiment, the venturi pump of the venturi pump system 206 uses the flow of coolant fluid 304 from the fluid system 202 via the fluid system outlet to create a vacuum that extracts the trapped gas 310 from the fluid system 202 via the outlet at 314. In one embodiment, the coolant system pump 209 provides coolant pressure for this flow.

The venturi pump reduces the time for de-aerating the fluid system 202 on start-up of the engine after the engine and associated fluid flow lines have been initially filled with coolant fluid. The venturi pump also improves efficiency of the de-aeration as the venturi pump continuously applies a suction to the gas trapping location and insures that the fluid system 202 will be full of coolant fluid at all times as entrapped gas is continuously removed.

A system and method in accordance with the present invention for removing gas from an engine coolant system has been disclosed. The method includes collecting gas in a fluid system. A pump system that includes a venturi pump extracts both gas and coolant fluid from the fluid system. As a result, gas is extracted from the engine coolant system in a simple and efficient manner.

The present invention has been described in accordance with the embodiments shown. One of ordinary skill in the art will readily recognize that there could be variations to the embodiments, and that any variations would be within the spirit and scope of the present invention. Accordingly, many modifications may be made by one of ordinary skill in the art without departing from the spirit and scope of the appended claims.

What is claimed is:

1. An engine coolant system using an engine coolant comprising:

a fluid system that is operable to collect gas;

a gas collection system coupled to the fluid system to receive gas from the fluid system; and a venturi pump system coupled to the fluid system and to the gas collection system, wherein the venturi pump system uses engine coolant flow to extract the gas from the fluid system via the gas collection system.

2. The system of claim 1 wherein the fluid system is further operable to collect coolant fluid, and wherein the venturi pump system is operable to extract both gas and coolant fluid from the fluid system.

3. The system of claim 1 wherein the gas collection system and the venturi pump system are external to the fluid system.

4. The system of claim 1 wherein the gas collection system and the venturi pump system are internal to the fluid system.

5. The system of claim 1 wherein the fluid system is oriented in a manner to consolidate the gas at a gas collection area.

6. The system of claim 1 wherein the fluid system comprises a container that is tilted such that the gas accumulates at a high point of the fluid system.

7. An engine system comprising:

an engine; and an engine coolant system coupled to the engine, the engine coolant system comprising:

a fluid system including a high portion operable to collect gas;

a gas collection system coupled to said high portion of the fluid system to receive gas from the fluid system; and a venturi pump system coupled to the fluid system and to the gas collection system, wherein the venturi pump system is operable to extract the gas from the fluid system via the gas collection system and to send the gas to the engine coolant system.

8. The engine system of claim 7 wherein the fluid system is further operable to collect coolant fluid, and wherein the venturi pump system is operable to extract both gas and coolant fluid from the fluid system.

9. The engine system of claim 7 wherein the gas collection system and the venturi pump system are external to the fluid system.

10. The engine system of claim 7 wherein the gas collection system and the venturi pump system are internal to the fluid system.

11. The engine system of claim 7 wherein the fluid system is oriented in a manner to consolidate the gas at a gas collection area.

12. The engine system of claim 7 wherein the fluid system comprises a container that is tilted such that the gas accumulates at a high point of the fluid system.

13. A method for removing gas from an engine coolant system containing an engine coolant, the method comprising:

using a fluid system within the engine coolant system to collect gas; and using a venturi pump system within the engine coolant system to extract the collected gas from the fluid system via gas collection system, wherein the venturi pump system uses engine coolant flow to extract the gas from the fluid system.

14. The method of claim 13 further comprising:

collecting coolant fluid in the fluid system; and extracting the coolant fluid from the fluid system via a fluid system outlet, wherein the fluid system outlet is separate from the gas collection system.

15. The method of claim 13 wherein the fluid system is oriented in a manner to consolidate the gas at a gas collection area.

16. The method of claim 13 wherein the gas collection system and the venturi pump system are external to the fluid system.

17. The method of claim 13 wherein the gas collection system and the venturi pump system are internal to the fluid system.

18. The method of claim 13 wherein the fluid system comprises a container that is tilted such that the gas accumulates at a high point of the fluid system.

19. The engine system of claim 7, wherein said fluid system includes an exhaust gas recirculation cooler, said high portion being positioned within said exhaust gas recirculation cooler.

20. The method of claim 13, wherein said fluid system includes an exhaust gas recirculation cooler, said venturi pump system extracting gas from said exhaust gas recirculation cooler.

* * * * *